US007179974B2

(12) United States Patent
Muramatsu

(10) Patent No.: US 7,179,974 B2
(45) Date of Patent: Feb. 20, 2007

(54) METHOD FOR RETROFITTING ACOUSTIC KEYBOARD MUSICAL INSTRUMENT, METHOD FOR FORMING HOLES AND GADGET USED THEREIN

(75) Inventor: Shigeru Muramatsu, Shizuoka-ken (JP)

(73) Assignee: Yamaha Corporation, Shizuoka-Ken (JP)

( * ) Notice: Subject to any disclaimer, the term of this patent is extended or adjusted under 35 U.S.C. 154(b) by 599 days.

(21) Appl. No.: 10/775,895

(22) Filed: Feb. 10, 2004

(65) Prior Publication Data

US 2004/0163526 A1 Aug. 26, 2004

(30) Foreign Application Priority Data

Feb. 21, 2003 (JP) ..... 2003-044293

(51) Int. Cl.
*G10F 1/02* (2006.01)

(52) U.S. Cl. ..... 84/13

(58) Field of Classification Search ..... 84/13, 84/25, 18, 20, 27, 29, 30, 65–69, 105, 107–114
See application file for complete search history.

(56) References Cited

U.S. PATENT DOCUMENTS

| | | | | |
|---|---|---|---|---|
| 5,251,529 | A | 10/1993 | Burgett | |
| 5,521,795 | A * | 5/1996 | Burgett et al. | 361/825 |
| 5,783,765 | A * | 7/1998 | Muramatsu | 84/615 |
| 5,861,566 | A | 1/1999 | Kaneko et al. | |
| 5,994,632 | A * | 11/1999 | Muramatsu et al. | 84/18 |
| 6,420,642 | B1 * | 7/2002 | Muramatsu et al. | 84/724 |
| 6,552,251 | B2 * | 4/2003 | Muramatsu et al. | 84/3 |
| 6,940,005 | B2 * | 9/2005 | Muramatsu et al. | 84/21 |
| 2001/0003945 | A1 * | 6/2001 | Muramatsu et al. | 84/658 |
| 2001/0007218 | A1 * | 7/2001 | Tamaki et al. | 84/20 |
| 2001/0047713 | A1 * | 12/2001 | Muramatsu et al. | 84/3 |
| 2002/0062728 | A1 * | 5/2002 | Muramatsu et al. | 84/724 |
| 2003/0070526 | A1 * | 4/2003 | Muramatsu et al. | 84/21 |
| 2004/0025674 | A1 * | 2/2004 | Muramatsu et al. | 84/719 |
| 2005/0139060 | A1 * | 6/2005 | Muramatsu | 84/719 |
| 2005/0211048 | A1 * | 9/2005 | Fujiwara | 84/13 |
| 2005/0241461 | A1 * | 11/2005 | Kato et al. | 84/600 |
| 2006/0053999 | A1 * | 3/2006 | Sasaki | 84/13 |
| 2006/0054010 | A1 * | 3/2006 | Sasaki | 84/744 |
| 2006/0090633 | A1 * | 5/2006 | Muramatsu | 84/723 |
| 2006/0213357 | A1 * | 9/2006 | Ohba | 84/723 |

FOREIGN PATENT DOCUMENTS

| | | |
|---|---|---|
| JP | 9-237082 | 9/1997 |

* cited by examiner

*Primary Examiner*—Ross Gushi
(74) *Attorney, Agent, or Firm*—Harness, Dickey & Pierce, P.L.C.

(57) ABSTRACT

Upon request for retrofitting, workers bring a gadget and a marking tool and other tools to the user's home; the workers attach the marking tool to a keyboard, mark locators on a key bed by using the marking tool, form locating recesses therein, and bore reference seal holes by using a template, counter holes of which are aligned with the locating recesses; subsequently, the workers relate the gadget with the reference seal holes, bore through-holes in the key bed at target spots exactly below the black and white keys under the guide of the reference seal holes, and assemble a key drive unit with the key bed so that plungers pass through the through-holes; since the reference seal holes have been related with the keyboard, the gadget sequentially positions a drill at the target spots also related to the keyboard.

21 Claims, 11 Drawing Sheets

METHOD FOR RETROFITTING ACOUSTIC KEYBOARD MUSICAL INSTRUMENT, METHOD FOR FORMING HOLES AND GADGET USED THEREIN

FIELD OF THE INVENTION

This invention relates to a retrofitting work on an acoustic keyboard musical instrument and, more particularly, to a method for retrofitting an acoustic keyboard musical instrument, a method for forming holes incorporated in the method and a gadget used in the retrofitting work.

DESCRIPTION OF THE RELATED ART

An automatic player piano is fabricated on the basis of an acoustic piano, and includes an automatic player. This means that either of or both of the automatic player and human pianist play a music passage on the keyboard. An array of solenoid-operated key actuator units and a controller are essential parts of the automatic player. The controller selectively energizes the solenoid-operated key actuator units with electric signals, and the keys are driven for rotation by the solenoid-operated key actuator units thus energized with the electric signals without the fingering of the human player.

The keyboard is mounted on the key bed. The space between the key bed and the keyboard is so narrow that the manufacturer thinks it impossible to install an array of strong solenoid-operated key actuator units on the key bed. For this reason, the array of solenoid-operated key actuators is usually hung from the key bed by means of a frame. In this instance, the key bed is formed with a slit, which laterally extends below the rear portions of the keys, and the plungers project through the slit over the key bed for pushing the rear portions of the keys. Thus, most of the automatic player pianos have the key beds formed with the slits.

Typical examples of the array of solenoid-operated key actuator units, which are hung from the key bed, are disclosed in U.S. Pat. No. 5,251,529, U.S. Pat. No. 5,521,795 and U.S. Pat. No. 5,861,566. U.S. Pat. No. 5,861,566 had been filed on the basis on the Japanese Patent Application, which was laid open as Japanese Patent Application of Unexamined Application hei 9-237082. When the user requests the manufacturer to retrofit the acoustic piano, the workers disassemble the acoustic piano, and lay the piano cabinet on a working table, then, machining the key bed for the slit. Upon completion of the machining, the solenoid-operated key actuator units are secured to the key bed with the frame, and the component parts are assembled into the acoustic piano, again.

A problem is encountered in that the prior art retrofitting work is costly. First, the manufacturer consumes a large amount of time and labor in the disassemble work and assemble work. Second, the slit is to be accurately formed in the key bed at user's home. The workers have to prudentially conduct the works, and the prudence makes the works slow down. If the workers were carried out in a machine shop, they would exactly quickly finish the works. However, only the handy tools and portable measuring instruments give the assistance to the workers. This is another factor to cost the manufacturer. Third, the slit has influences on the relativity among the component parts on the key bed, and various tuning works are required for the reassembled acoustic piano. Additional time and labor are consumed, and makes the production cost increased.

SUMMARY OF THE INVENTION

It is therefore an important object of the present invention to provide a method for retrofitting an acoustic keyboard musical instrument which is economical without sacrifice of good finish.

It is another important object of the present invention to provide a method for forming holes, which are exactly related to a keyboard of the acoustic keyboard musical instrument.

It is also another important object of the present invention to provide a gadget used in the retrofitting work.

To accomplish the object, the present invention proposes to make reference seals on a key bed relate a gadget to a keyboard.

In accordance with one aspect of the present invention, there is provided a method for retrofitting a keyboard musical instrument to an automatic player keyboard instrument comprising the steps of preparing an automatic playing system to be assembled with a keyboard musical instrument, which includes a cabinet having a stationary board, a keyboard having plural keys and mounted on the stationary board and a tone generating system responsive to a fingering on the keyboard for generating tones, marking at least one reference seal in the stationary board at a certain position determined on the basis of the keyboard so that the at least one reference seal is related to the keyboard, making a gadget related to the keyboard through the at least one reference seal, forming holes at target positions in the stationary board by means of the gadget already related to the keyboard so that the holes are exactly located below the keys, respectively, and assembling a key drive unit of the automatic playing system with the stationary board in such a manner that plural plungers of the key drive unit pass through the holes, respectively.

In accordance with another aspect of the present invention, there is provided a method for forming holes in a stationary board where a keyboard is to be mounted comprising the steps of marking at least one reference seal in the stationary board at a certain position determined on the basis of the keyboard so that the at least one reference seal is related to the keyboard, making a gadget related to the keyboard through the at least one reference seal, and forming holes at target positions in the stationary board by means of the gadget already related to the keyboard so that the holes are exactly located below the keys, respectively.

In accordance with yet another aspect of the present invention, there is provided a gadget for forming holes at target positions in a stationary board of a keyboard musical instrument marked with at least one reference seal at a certain position determined on the basis of a keyboard incorporated in the keyboard musical instrument, and the gadget comprises a boring unit movable in an area where the keyboard musical instrument stands and having a cutting tool movable toward the stationary board for boring the holes in the stationary board, an adjusting device making the boring unit related to the keyboard through the at least one reference seal and a positioning device moving the cutting tool to the target positions in the stationary board, wherein the target positions are determined on the basis of the at least one reference seal and pieces of positional data representative of a relation between keys incorporated in the keyboard so that the holes are exactly located below the keys, respectively.

BRIEF DESCRIPTION OF THE DRAWINGS

The features and advantages of the methods and gadget will be more clearly understood from the following description taken in conjunction with the accompanying drawings, in which.

DESCRIPTION OF THE PREFERRED EMBODIMENTS

Structure of Automatic Player Piano

Figure 1:
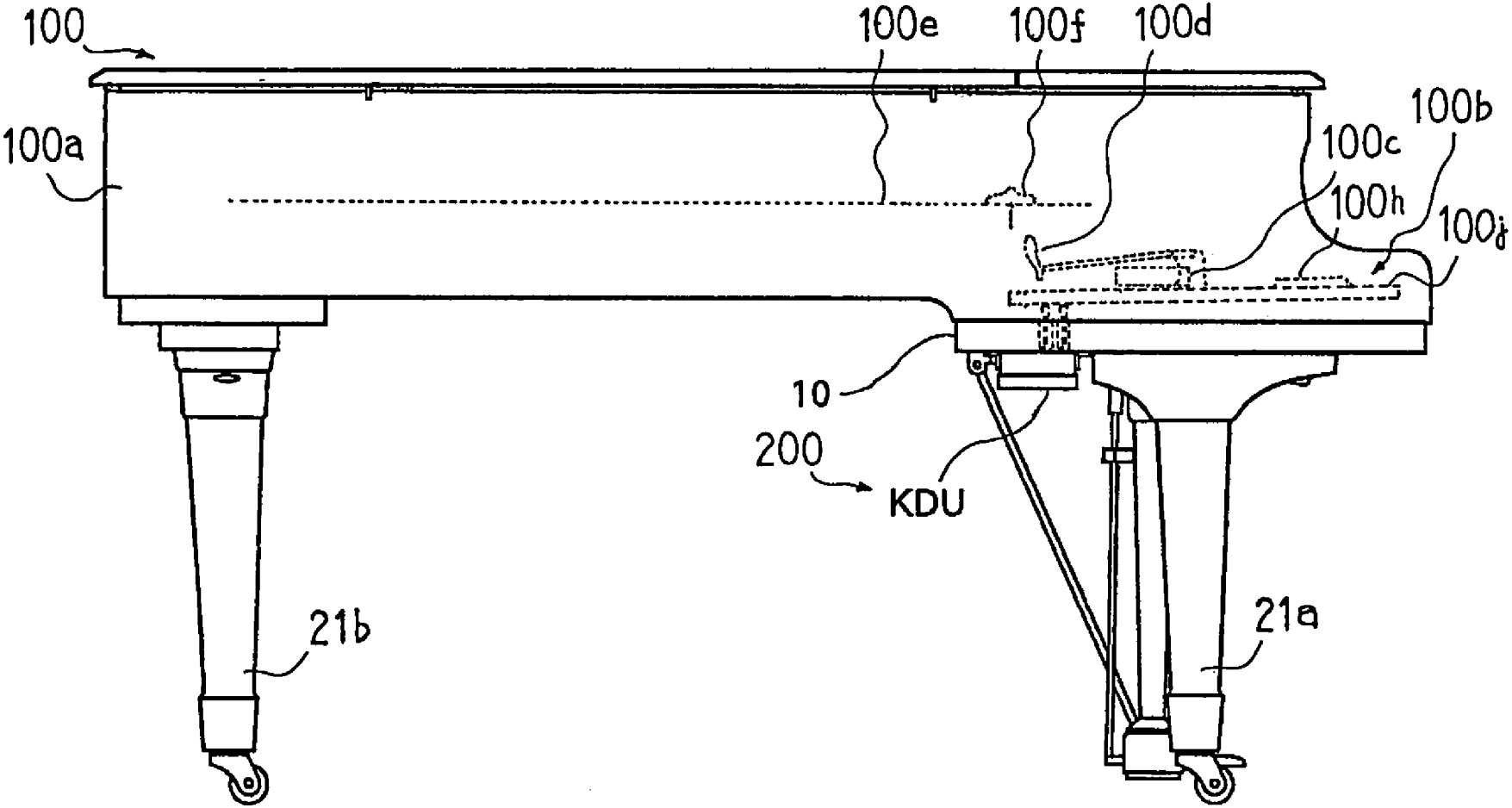
FIG. 1 is a side view showing the external appearance of an automatic player piano.

Referring to FIG. 1 of the drawings, an automatic player piano embodying the present invention largely comprises an acoustic piano 100 and an automatic playing system 200. A human player fingers music passages on the acoustic piano 100, and the automatic playing system 200 also plays the music passages without the fingering. The human player and automatic playing system 200 may play different parts of a piece of music. Thus, both human and mechanical players can play pieces of music on the acoustic piano 100.

In the following description, term "front" is indicative of a position closer to a pianist, who sits on a stool for his or her performance, than a "rear" position. A term "fore-and-aft direction" is in parallel to the line drawn from a front position and the corresponding rear position, and "lateral direction" crosses the fore-and-aft direction at right angle.

The acoustic piano 100 includes a piano cabinet 100*a*, a keyboard 100*b*, action units 100*c*, hammers 100*d*, strings 100*e* and dampers 100*f*. A key bed 10 defines a part of the bottom of the piano cabinet 100*a*, and the keyboard 100*b* is mounted on the key bed 10. The action units 100*c*, hammers 100*d*, strings 100*e* and dampers 100*f* are housed in the piano cabinet 100*a*, and black keys 100*h* and white keys 100*j*, which form parts of the keyboard 100*a*, are linked to the dampers 100*f* and through the action units 100*c* to the hammers 100*d*. While the human player is fingering a piece of music on the keyboard 100*b*, the black keys 100*h* and white keys 100*j* are selectively depressed and released, and the action units, which are linked with the depressed keys 100*h*/100*j*, drive the associated hammers 100*d* for rotation so that the hammers 100*d* strike the associated strings 100*e*. Thus, the acoustic piano tones are generated from the vibrating strings 100*e* through the process similar to a standard grand piano.

The automatic playing system 200 includes a key drive unit KDU and a manipulating panel (not shown). The manipulating panel is connected to the key drive unit KDU, and a user communicates with the key drive unit KDU through the manipulating panel. When the user instructs the key drive unit KDU to perform a piece of music through the manipulating panel, the key drive unit KDU sequentially moves the black keys 100*h* and white keys 100*j*, and cause the hammers 100*d* to strike the associated strings 100*e* as if the human player fingers. Thus, the key drive unit KDU performs pieces of music without any fingering of the human player.

Figure 2:
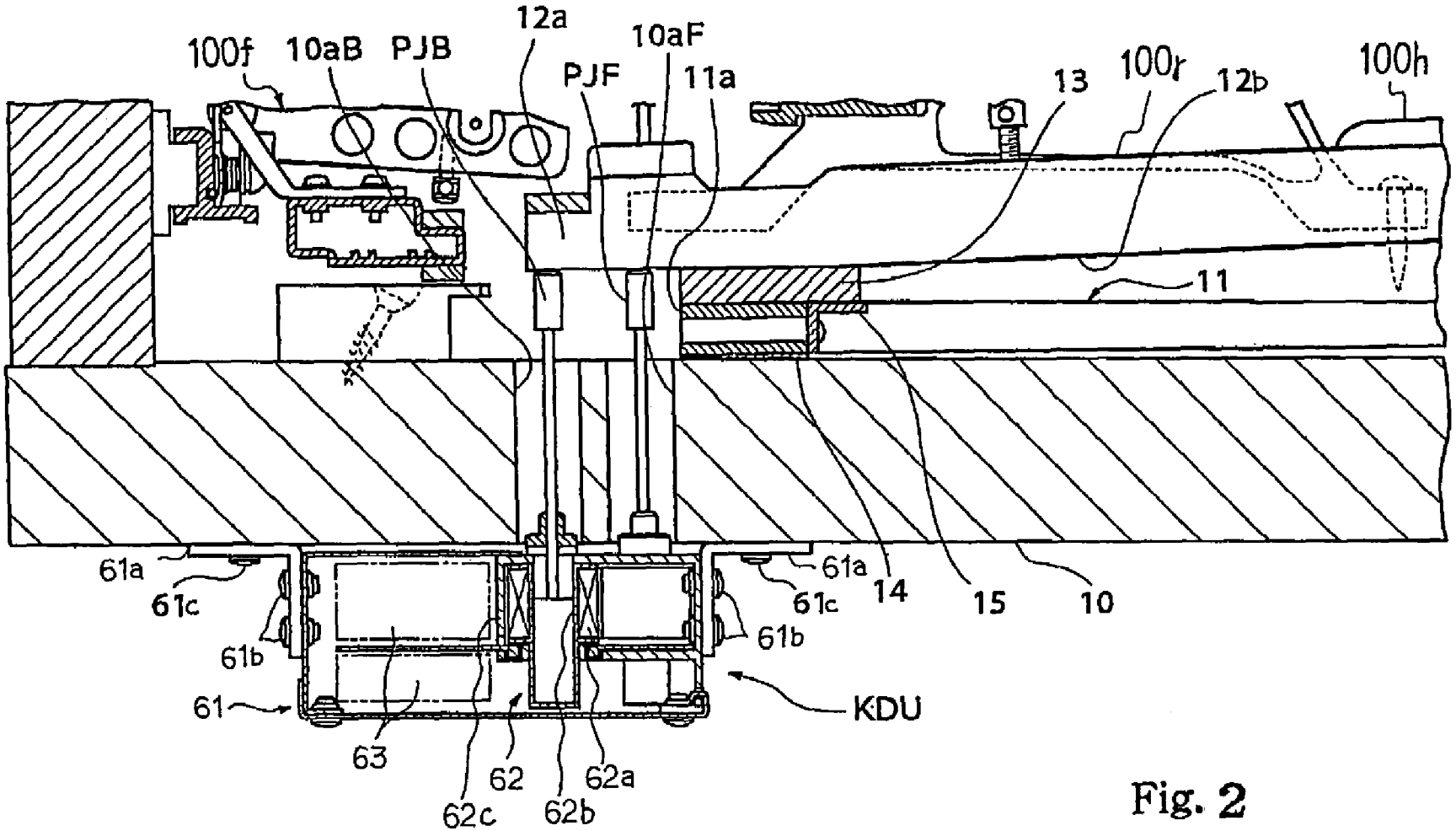
FIG. 2 is a cross sectional view showing a key drive unit incorporated in the automatic player piano.

The key drive unit KDU is illustrated in FIG. 2. Reference numerals 12*a* and 12*b* designate a rear portion of the black key or white key 100*j*/100*h* and a lower surface of the black key or white key 100*j*/100*h*, respectively. A front rail (not shown), a balance rail (not shown), a back rail 13 and tie plates are assembled into the key frame 11, and the black keys 11*j* and white keys 11*h* are placed on the balance rail in such a manner as to be moved like a seesaw. As will be described hereinlater in detail, rear portions are cut from the tie plates, and a back rail back-up plate 15 is connected to the rear end portions of the tie plates. Although the back rail 13 loses the rear portions of the tie plates, the back rail back-up plate 15 supports the back rail 13, and a spacer 14 is inserted between the key bed 10 and the back rail back-up plate 15. Thus, the back rail back-up plate 15 and spacer 14 are required for the retrofitting work.

Through-holes 10*a*F and 10*a*B are formed in the key bed 10, and are laterally arranged in a staggered fashion below the rear portions 12*a* of the black/white keys 100*j*/100*h*. Since the rear portions of the tie plates have been already cut away, the through-holes 10*a*F/10*a*B are opposed to the rear portions of the black and white keys 100*j*/100*h*. In this instance, eighty-eight black and white keys 100*j*/100*h* are incorporated in the keyboard 100*b*, and, accordingly, eighty-eight through-holes 10*a*F/10*a*B are arranged in two rows. The key drive unit KDU is hung from the certain region of the key bed 10 where the through-holes 10*a*F and 10*a*B are formed so as to be able to push the lower surfaces 12*b* of the rear portions 12*a* through the through-holes 10*a*F and 10*a*B.

The key drive unit KDU is like that disclosed in U.S. Pat. No. 5,861,566, and includes a framework 61, an array of solenoid-operated key actuators 62 and a controller 63. The framework 61 is secured to brackets 61*a* by means of bolts 61*b*, and the brackets 61*a* are secured to the lower surface of the key bed 10 by means of bolts 61*c*. Each of the solenoid-operated key actuators 62 includes a solenoid 62*a*, a bobbin 62*b* and a plunger PJF/PJB. A yoke 62*c* is shared among the solenoid-operated key actuators 62, and is secured to the framework 61. The solenoid-operated key actuators 62 are arranged in the staggered fashion, and are respectively assigned the through-holes 10*a*F/10*a*B. When the framework 61 is properly secured to the lower surface of the key bed 10, the plungers PJF/PJB pass through the through-holes 10*a*F/10*a*B, and the tips of the plungers PJF/PJB reach rest positions beneath the lower surfaces 12*b* of the rear portions 12*a* of the associated black and white keys 100*j*/100*h*.

When a user instructs the controller 63 to perform a piece of music through the manipulating panel, the controller 63 sequentially receives music data codes, which may be formatted in accordance with the MIDI (Musical Instrument Digital Interface) standards, and selectively energizes the solenoids 62*a* with the driving signal. The solenoids 62*a* energized with the driving signal create magnetic fields, and the magnetic force is exerted on the associated plungers PJF/PJB upwardly. Then, the plungers PJF/PJB project from the associated solenoids 62*a*, and push the lower surfaces 12*b* of the rear portions of the associated black and white keys 100*j*/100*h*. Thus, the array of solenoid-operated key actuators 62 gives rise to the see-saw motion of the black and white keys 100*j*/100*h* without any fingering of a human pianist for the piece of music.

Retrofitting Work

The automatic player pianos are built up in the manufacturer's factory. Otherwise, acoustic pianos are retrofitted to the automatic player pianos at user's home. In the latter case, workers carry tools, handy machines and component parts of the automatic playing system 200 to user's home. The workers machine the key bed 10 and key frame 11, and assemble the component parts with the acoustic piano 100. The workers mark reference seals P2 on the key bed 10, and bore the through-holes 10*a*F/10*a*B in the key bed 10. Predetermined component parts of the acoustic piano 100 are machined, and the automatic playing system 200 is assembled with the acoustic piano 100. Thus, the retrofitting work includes the reference seal marking step, through-hole boring step, associated machining step and assembling step. The reference seal marking step, through-hole boring step and assembling step are to be carried out in that order. However, the workers can carry out the associated machining works in parallel to the reference seal marking work and/or through-hole boring work.

Reference Seal Marking Work

Figure 3:
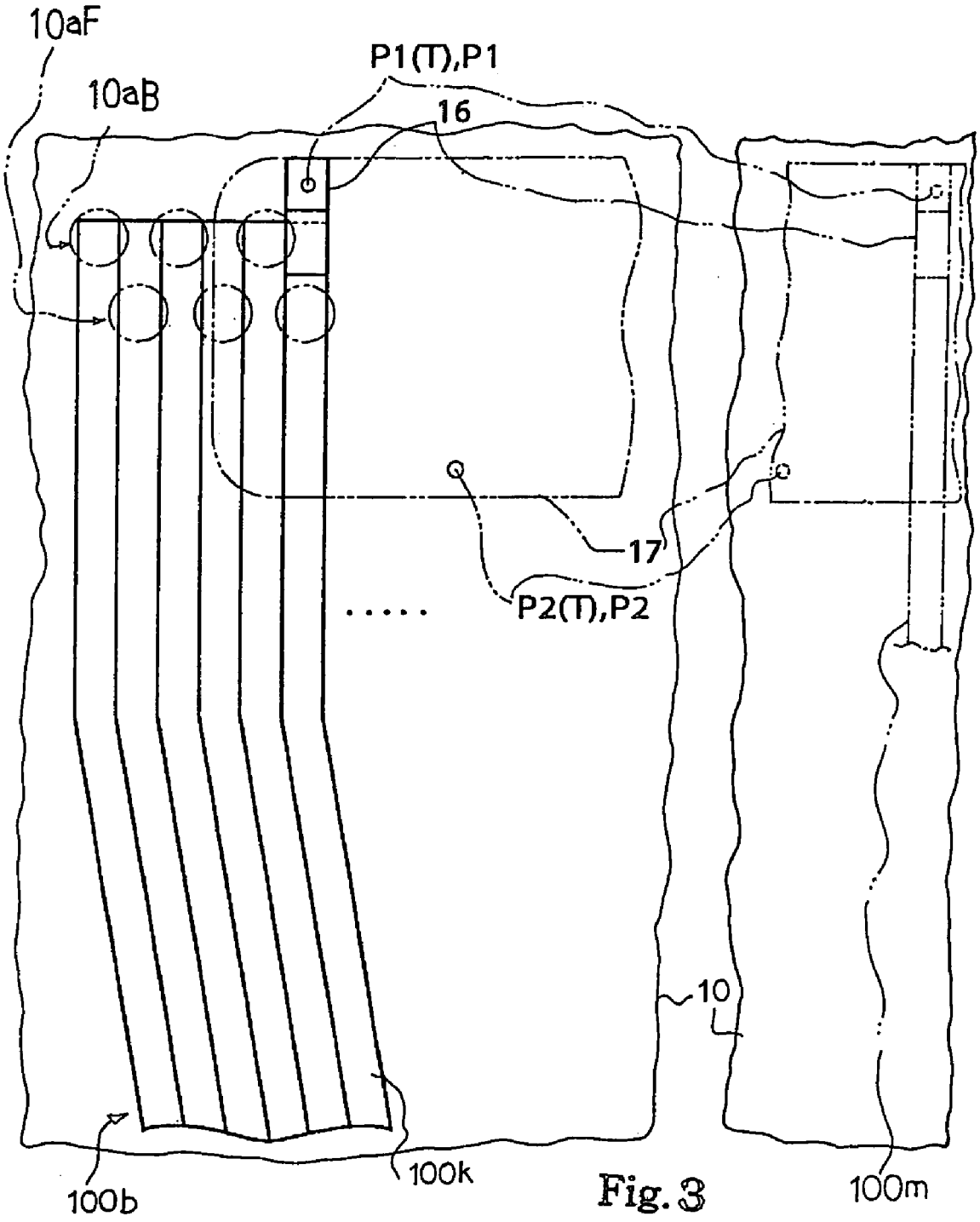
FIG. 3 is a plane view showing a reference seal marking work.

FIG. 3 shows the reference seal marking work on the key bed 10. The six black and white keys are located at the leftmost position of the keyboard 100*b*, and the sixth key is labeled with reference numeral 100*k*. The eighty-third key, which is the sixth key from the rightmost one, is labeled with reference numeral 100*m*.

At least two locators P1 are to be formed in the key bed 10 together with at least two reference seals P2 in the reference seal marking work. The locators P1 make a template 17 exactly located in a target position, which is to be based on the keyboard 100*b*, on the key bed 10, and the reference seals P2 are marked in the key bed 10 by using the template 17. For this reason, the reference seals P2 are located on the basis of the keyboard 100*b*, and are relative to the key bed 10. Even if the keyboard 100*b* is deviated on the key bed 10, the reference seals P2 are exactly marked at target positions on the basis of the keyboard 100*b*. In this instance, the locators P1 are implemented by shallow recesses, and the reference seals P2 are implemented by holes. In the following description, the shallow recesses are referred to as "locating recesses", and the holes are referred to as "reference seal holes".

One of the locating recess P1 and associated reference seal hole P2 are formed in the left portion of the key bed 10, and the other locating recess P1 and associated reference seal hole P2 are formed in the right portion of the key bed 10. The left locating recess P1 is based on the key 100*k*, and the left reference seal hole P2 is determined by the left locating recess P1 through the template 17. This results in that the left reference seal hole P2 is located on the basis of the key 100*k*. On the other hand, the right locating recess P1 is located on the basis of the key 100*m*, and the right reference seal hole P2 is determined by the right locating recess P1 through the template 17. This also results in that the right reference seal hole P2 is located on the basis of the key 100*m*. Thus, the reference seal holes P2 are bored in the key bed 10 on the basis of the keyboard 100*b*.

The workers are assumed to have already known details of the acoustic piano 100 such as, for example, the model, type and manufacturing data such as the pitches of the black and white keys 100*h*/100*j*. Various templates had been prepared for the retrofitting work on various models of the acoustic piano 100, and the workers selected the template 17 from them. The workers bring the template 17 to the user's home together with the gadget and other tools.

The reference seal marking work is broken down into two sub-works. The first sub-work is to form the locating recesses P1 in the key bed 10, and the reference seal holes P2 are bored in the key bed 10 in the second sub-work.

Figure 4:
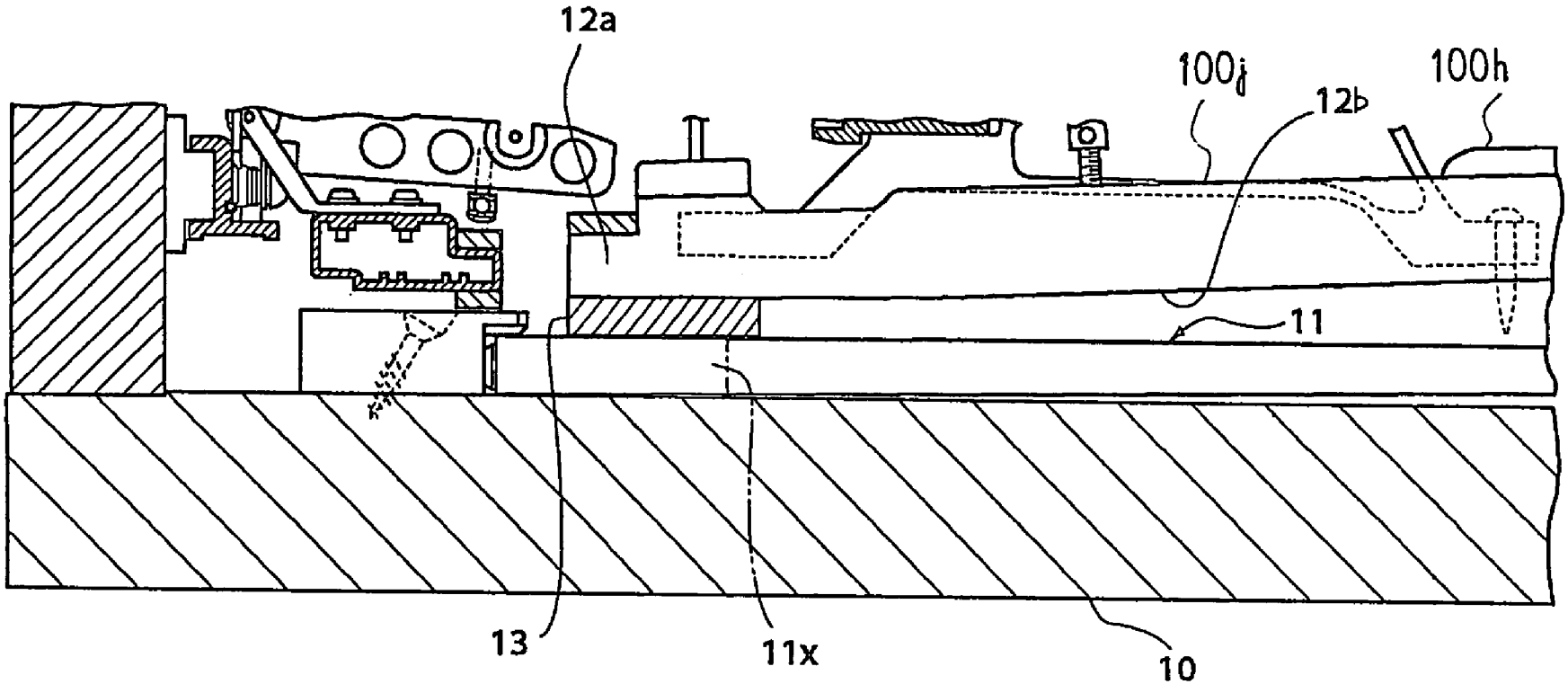
FIG. 4 is a cross sectional view showing a white key 100*j* before a retrofitting work.

Prior to the first sub-work, the workers remove the keyboard 100*b*, that is, the combined structure of the array of black and white keys 100*h*/100*j* and key frame 11 from the key bed 10. The tie plates too long so that the rear portions 11*x* (see FIG. 4) are cut away from the tie plates, and the back rail back-up plate 15 is connected to the tie plates. The back rail 13 is forwardly moved, and the spacer 14 is secured to the lower surface of the back rail back-up plate 15. Thus, the keyboard 100*b* gets ready for the retrofitting.

Figure 5:
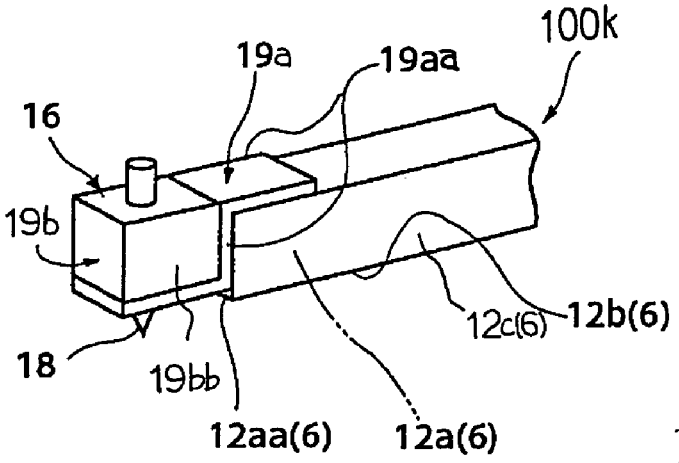
FIG. 5 is a perspective view showing a marking tool attached to a key.
Figure 6:
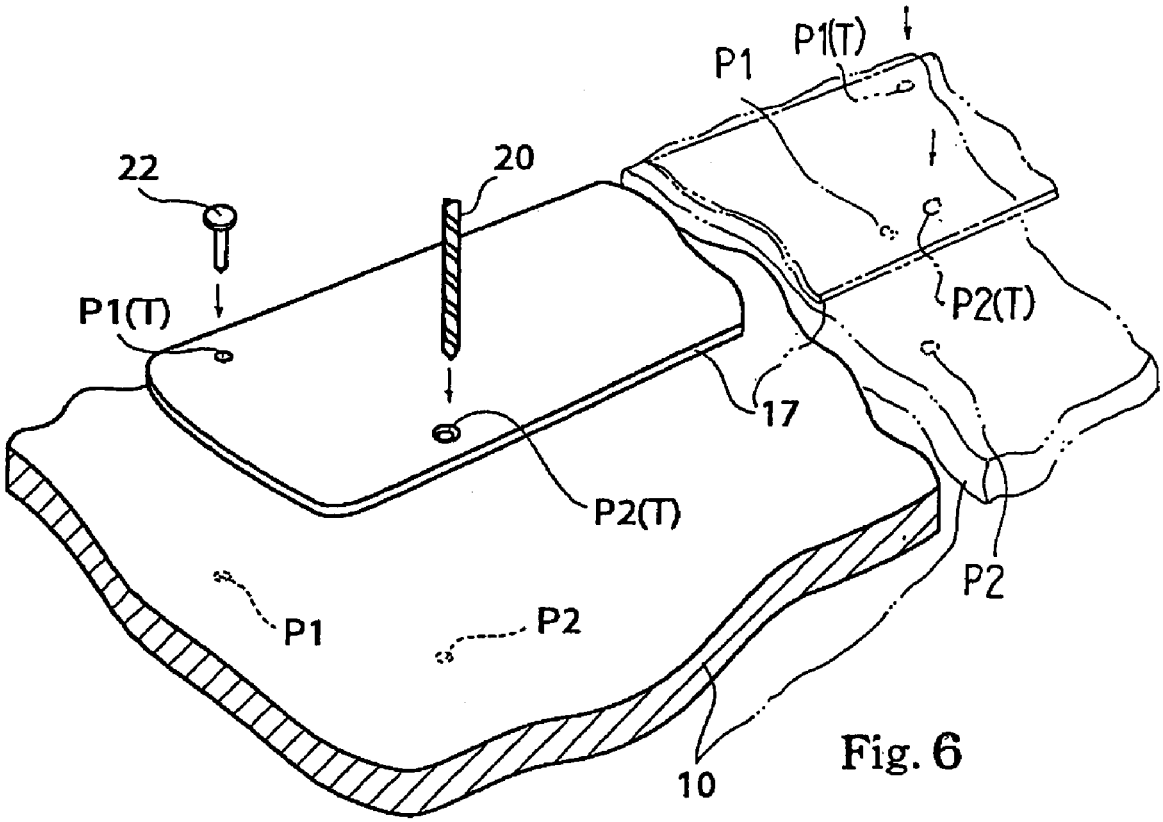
FIG. 6 is a perspective view showing a template on a key bed.

The first sub-work proceeds as follows. Marking tools 16 are attached to the sixth and eighty-third keys 100*k* and 100*m*, respectively. FIG. 5 shows the left marking tool 16 attached to the rear portion of the sixth key 100*k*. The rear surface and side surfaces of the key 100*k* are labeled with reference numerals 12*aa*(6) and 12*c*(6), respectively. The left marking tool 16 includes a felt pen 18, a bracket 19*a* and a penholder 19*b*. The bracket 19*a* has a shape like a step, and is equal in width to the key 100*k*. The bracket 19*a* is constant in thickness, and the thickness is adjusted to a target value. The penholder 19*b* is cubic, and is also equal in width to the key 100*k*. The felt pen 18 is attached to the penholder 19*b*, and the penholder 19*b* is secured to the bracket 19*a*. The penholder 19*b* makes the tip of the felt pen 18 positioned on a centerline of the bracket 19*a*, and spaces the tip from the vertical surface of the bracket 19*a* by a predetermined distance. Though not shown in FIG. 5, a through-hole is bored in the bracket 19*a*, and the felt pen 18 downward projects from the bracket 19*a*. The bracket 19*a* has side surfaces 19*aa*, and the penholder 19*b* also has side surfaces 19*bb*. The pen holder 19*b* is attached to the bracket 19*a* in such a manner that the side surfaces 19*bb* are coplanar with the side surfaces 19*aa*, and the marking tool 16 is secured to the key 100*k* in such a manner that the side surfaces 19*aa*/19*bb* are coplanar with the side surfaces 12*c*(6). As a result, the centerlines of the bracket/pen holder 19*a*/19*b* are aligned with the centerline of the key 100*k*. When the bracket 19*a* is secured to the key 100*k*, the marking tool 16 rearward projects from the rear surface 12*aa*(6). The tip of the felt pen 18 is on the extension line of the centerline of the key 100*k*, and is spaced from the rear surface 128*aa*(6) by a predetermined distance. Thus, the position of the tip of the felt pen 18 is absolute to the key 100*k*. The right marking tool 16 is same as the left marking tool 16, and the position of the tip is also absolute to the key 100*m*.

Subsequently, the workers bring the keyboard 100*b*, which the marking tools 16 have been already attached to, to the key bed 10, and place the keyboard on the key bed 10. The worker presses the felt pens 18 to the key bed 10. Then, two spots are marked on the key bed 10. These spots are located on the basis of the keyboard 100*b*. Even if another keyboard is mounted on the key bed 10 in an area differently from the area occupied by the keyboard 100*b*, the spots are absolute to the new keyboard, and are moved from those for the keyboard 100*b*.

The workers remove the keyboard 100*b* from the key bed 10, again. The spots, which were marked with the felt pens 18, are left on the upper surface of the key bed 10. The marking tools 16 are disassembled from the keys 100*h*/100*h*. The worker drills the locating recesses P1. The locating recesses P1 are, by way of example, 3 millimeters in diameter. The locating recesses P1 serve as the locators. Thus, the locators P1 are formed in the key bed 10 in the first sub-work.

The second sub-work follows the first sub-work. First, the template 17 is moved onto the key bed 10, and counter holes P1 (T) and guide holes P2 (T) have been already bored in the template 17. The counter holes P1 (T) are spaced from each other by a distance equal to the distance between the left locating recess P1 and the right locating recesses P1, and the guide holes P2 (T) are located on the basis of the counter holes P1 (T), respectively. In other words, the relative positions of the guide holes P2 (T) to the counter holes P1 (T) are designed to be same as the relative positions of the target positions of the reference seal holes P2 to the locating recesses P1. For this reason, when the counter holes P1 (T) are respectively aligned with the locating recesses P1, the target positions of the reference seal holes P2 are exposed to the guide holes P2 (T), respectively.

Pins 22 are inserted through the counter holes P1 (T) into the locating recesses P1, respectively, so that the template 17 is secured to the key bed 10 by means of the pins 22. A drill 20 is used for making the reference seal holes P2. The drill 20 is driven for rotation, and is pressed to the target positions through the guide holes P2 (T). The drill 20 penetrates the key bed 10. Then, the reference seal holes P2, which is, by way of example, 6 millimeters in diameter, are formed in the key bed 10, and the second sub-work is completed.

As will be understood, the reference seal holes P2 are bored on the basis of the locating holes P1, and the locating holes P1 have been formed with respect to the keyboard 100*b*. This results in that the reference seal holes P2 are bored in the key bed 10 on the basis of the keyboard 100*b*.

Through-Hole Boring Work

Figure 7:
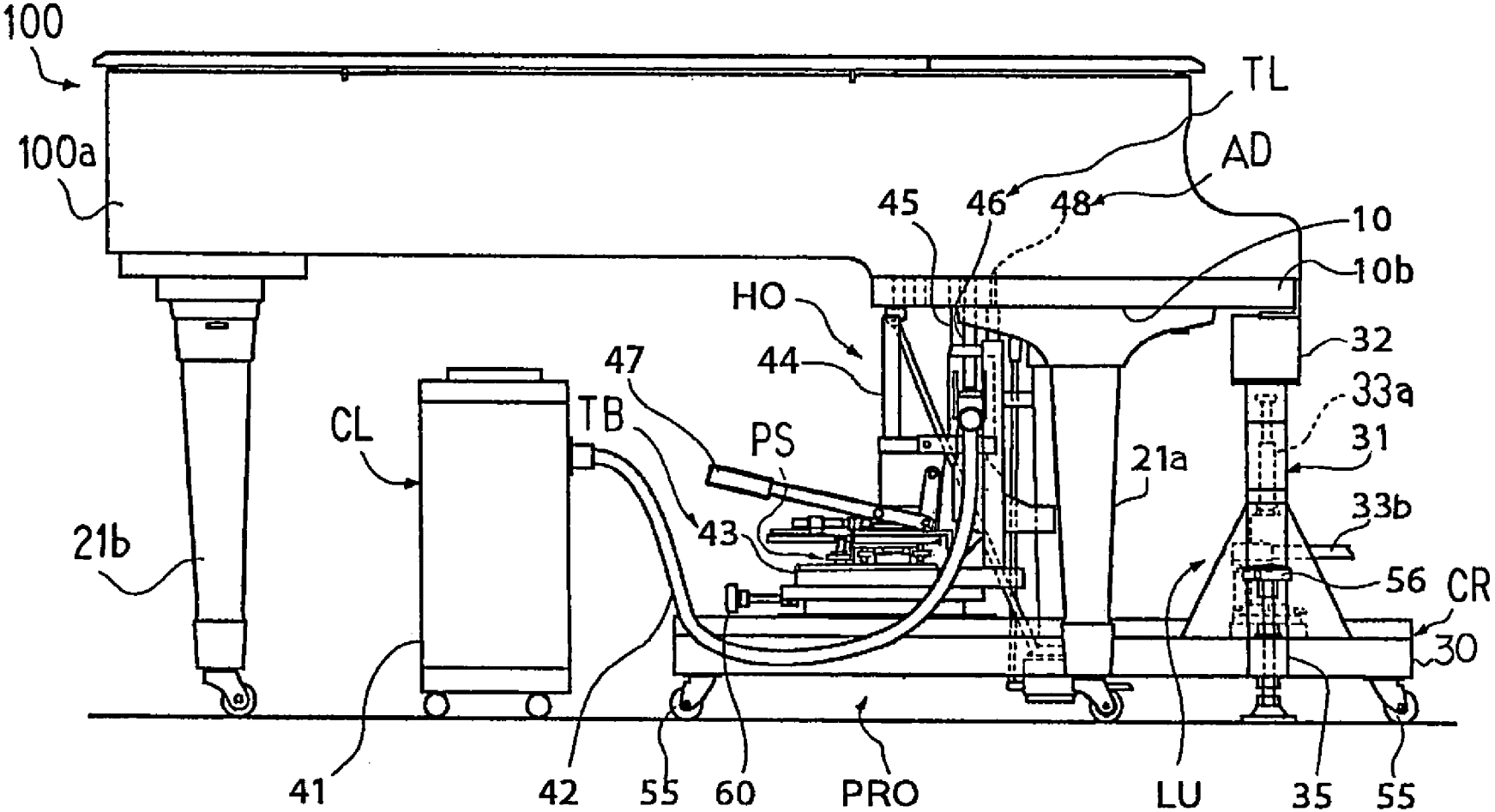
FIG. 7 is a side view showing a gadget placed under an acoustic piano.
Figure 8:
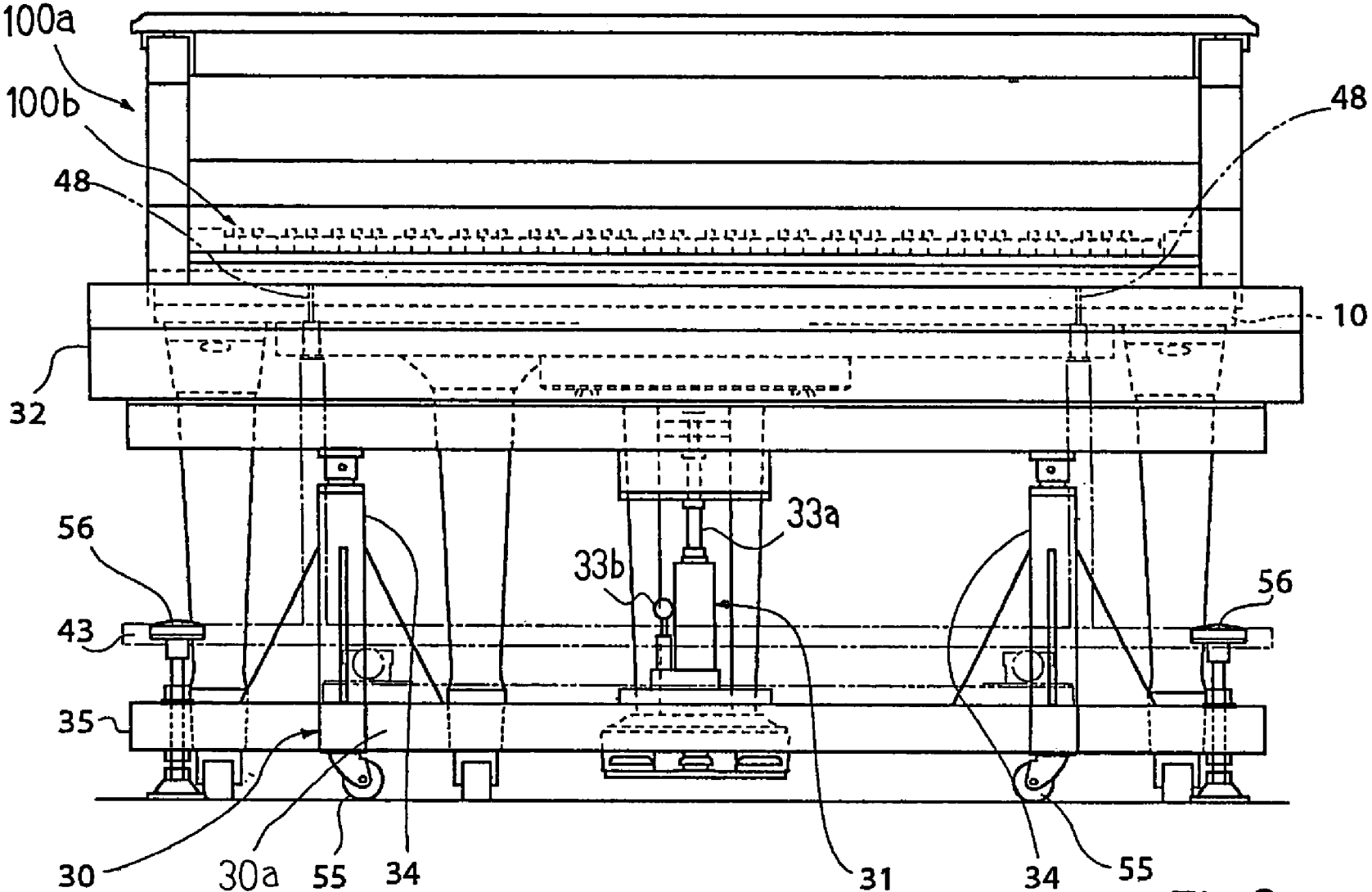
FIG. 8 is a front view showing a lifter incorporated in the gadget.
Figure 9:
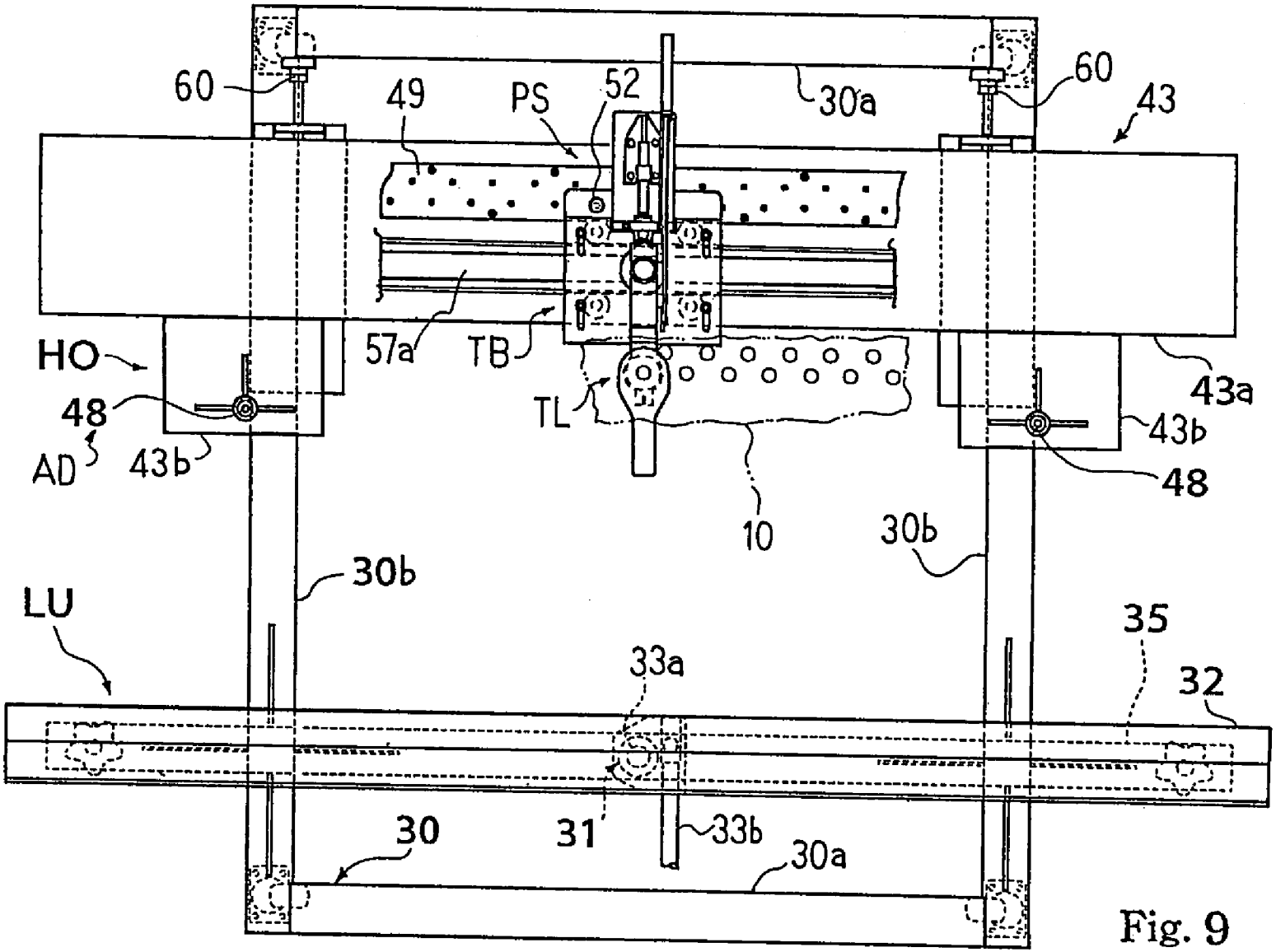
FIG. 9 is a plane view showing a boring machine also incorporated in the gadget.

The through-holes 10*a*F and 10*a*B are bored in the key bed 10 by using the gadget PRO. FIGS. 7, 8 and 9 show the gadget PRO. The gadget PRO is broken down into a lifter LU, a boring machine HO, a carrier CR and a cleaner CL. The boring machine HO is deleted from FIG. 8 so that the illustration is focused on the lifter LU. The boring machine HO is further illustrated in FIGS. 10 and 11. However, several component parts are deleted from FIGS. 10 and 11 for the sake of simplicity.

The boring machine HO and lifter LU are secured to the carrier CR, and the carrier CR allows the worker easily to move the boring machine HO and lifter LU into the space under the acoustic piano 100. The lifter LU pushes up a front end portion 10*b* of the piano cabinet 100*a* so that front legs 21*a*, which keep the piano cabinet 100*a* horizontal over the floor together with a rear leg 21*b*, float over the floor. The worker bores the through-holes 10*a*F and 10*a*B in the key bed 10 in the staggered manner by using the boring machine HO. While the boring machine HO is forming the through-holes 10*a*F and 10*a*B, the cleaner CL inhales the chips together with the air, and keeps the environment clean.

The carrier CR includes a framework 30, a long beam 35, casters 55 and stoppers 56. As will be better seen in FIG. 9, a pair of short lateral beams 30*a* and a pair of longitudinal beams 30*b* are assembled into the framework 30. The long beam 35 is fixed to the longitudinal beams 30*b*, and sideward projects from the longitudinal beams 30*b*. The casters 55 are secured to the four corners of the framework 30, and permit the framework 30 to slide on the floor in so far as the stoppers 56 are retracted. The stoppers 56 are secured to both end portions of the long beam 35, and are downwardly projectable and upwardly retractable. When the lifter LU reaches the space beneath the front end portion 10*b* in parallel to the keyboard 100*b*, the worker makes the stoppers 56 downwardly project from the long beam 35 so that the stoppers 56 push the floor. The stoppers 56 thus pressed against the floor prohibit the casters 55 from sliding on the floor.

Turning back to FIGS. 7 and 8, the lifter LU is provided on the front portion of the carrier CR, and includes a center jack 31, a lateral rigid beam 32 and a pair of jack supports 34. The jack 31 is provided at the center of the long lateral beam 35, and is secured thereto. The center jack includes a rod 33*a* and a lever 33*b*. The rod 33*a* is projectable from and retractable into the casing, and the lateral rigid beam 32 is fixed to the rod 33*a*. The lever 33*b* is connected to a suitable force converter (not shown), and the force converter moves the rod reciprocally in the up-and-down directions.

When the worker wishes to lift the front end portion 10*b*, he or she aligns the lateral rigid beam 35 with the front end portion 10*b*, and makes the lateral rigid beam 35 parallel to the keyboard 100*b*. The worker manipulates the lever 33*b* so that the force converter causes the rod 33*a* to project from the casing. The lateral rigid beam 32 is pressed to the front end portion 10*b*, and the front end portion 10*b* is lifted. This results in that the front legs 21*a* are spaced from the floor. The jack supports 34 are provided on both sides of the center jack 31, and are inserted between the long lateral beam 35 and the lateral rigid beam 32 so as to keep the front end portion 10*b* horizontal.

The boring machine HO is hereinafter described with reference to FIGS. 7, 9 and 10. The boring machine HO includes a tool table 43, an adjusting device AD, a two-dimensionally movable table TB, a positioning device PS and a boring tool TL. The tool table 43 is provided on the framework 30, and the adjusting device AD renders the tool table 43 positioned at a target position on the framework 30 with the assistance of the reference seal holes P2. Thus, the adjusting device AD cooperates with the reference seal holes P2 so that the tool table 43 is placed on the framework 30 on the basis of the keyboard 100*b*.

The tool table 43 carries the two dimensionally movable table TB, and the boring tool TL is provided on the two-dimensionally movable table TB. The two-dimensionally movable table TB is movable in the fore-and-aft direction and the lateral direction on the tool table 43, and the boring tool TL is secured to the tow-dimensionally movable table TB. This means that the boring tool TL is also two-dimensionally movable on the tool table 43. The worker bores the through-holes 10*a*F and 10*a*B in the key bed 10 by using the boring tool TL.

The positioning device PS is partially provided on the tool table 43, and is partially carried on the two-dimensionally movable table TB. The positioning device PS is connected to a predetermined area on the tool table 43, and relates the boring tool TL to the predetermined area on the tool table 43. Since the adjusting device AD and reference seal holes P2 have already related the tool table 43 to the keyboard 100*b*, the positioning device PS renders the boring tool TL related to the keyboard 100*b*. The positioning device PS has plural spots just below the target positions where the through-holes 10*a*F/10*a*B are to be bored. For this reason, the positioning device PS permits the boring tool TL to make a stop at any one of the spots. Thus, the adjusting device AD and positioning device PS exactly relate the boring tool TL to the keyboard 100*b*.

The tool table 43, adjusting device AD, two-dimensionally movable table TB, boring tool TL and positioning device PS are hereinafter described in more detail. The tool table 43 includes a table 43*a* and a pair of couplers 43*b*. The couplers 43*b* are laterally spaced from each other, and the table 43*a* is fixed to the couplers 43*b*. The gap between the couplers 43*b* is approximately equal to the gap between the longitudinal beams 30*b* of the framework 30 so that the table 43*a* is secured to the framework 30 by means of the couplers 43*b*. When the worker wishes to move the table 43 in the fore-and-aft direction, he or she releases the couplers 43*a* from the longitudinal beams 30*b*, and slides the couplers 43*b* on the longitudinal beams 30*b*. Thus, the tool table 43 is locatable at a position appropriate to the acoustic piano 100.

As shown in FIG. 9, the adjusting device AD includes a pair of sealing poles 48 and a pair of adjusters. The sealing poles 48 are upright on the tool table 43, and are spaced from each other by a distance equal to the distance between the reference seal holes P2. In this instance, the sealing poles 48 are provided on the couplers 43*b*. The sealing poles 48 have respective tips equal in diameter to the reference seal holes P2, i.e., 6 millimeters, and, accordingly the tips are snugly received in the reference seal holes P2, respectively. The sealing poles 48 further have springs, which always urge the tips upwardly, so that the tips are pressed to the key bed 10 after the insertion into the reference seal holes P2. The adjusters 60 are, respectively linked with the sealing poles 48, and the worker moves the associated sealing poles 48 in the up-and-down direction by manipulating the adjusters 60.

When the worker wishes to locate the tool table 43 at the appropriate position exactly related to the keyboard 100*b*, the worker loosens the couplers 43*b*, and aligns the tips of the sealing poles 48 with the reference seal holes P2, respectively. The worker projects the tips by manipulating the adjusters 60. Then, the tips are snugly received into the reference seal holes P2. Finally, the worker secures the couplers 43*b* to the longitudinal beams 30*b* so that the tool table 43 is exactly related to the keyboard 100*b*.

Figure 10:
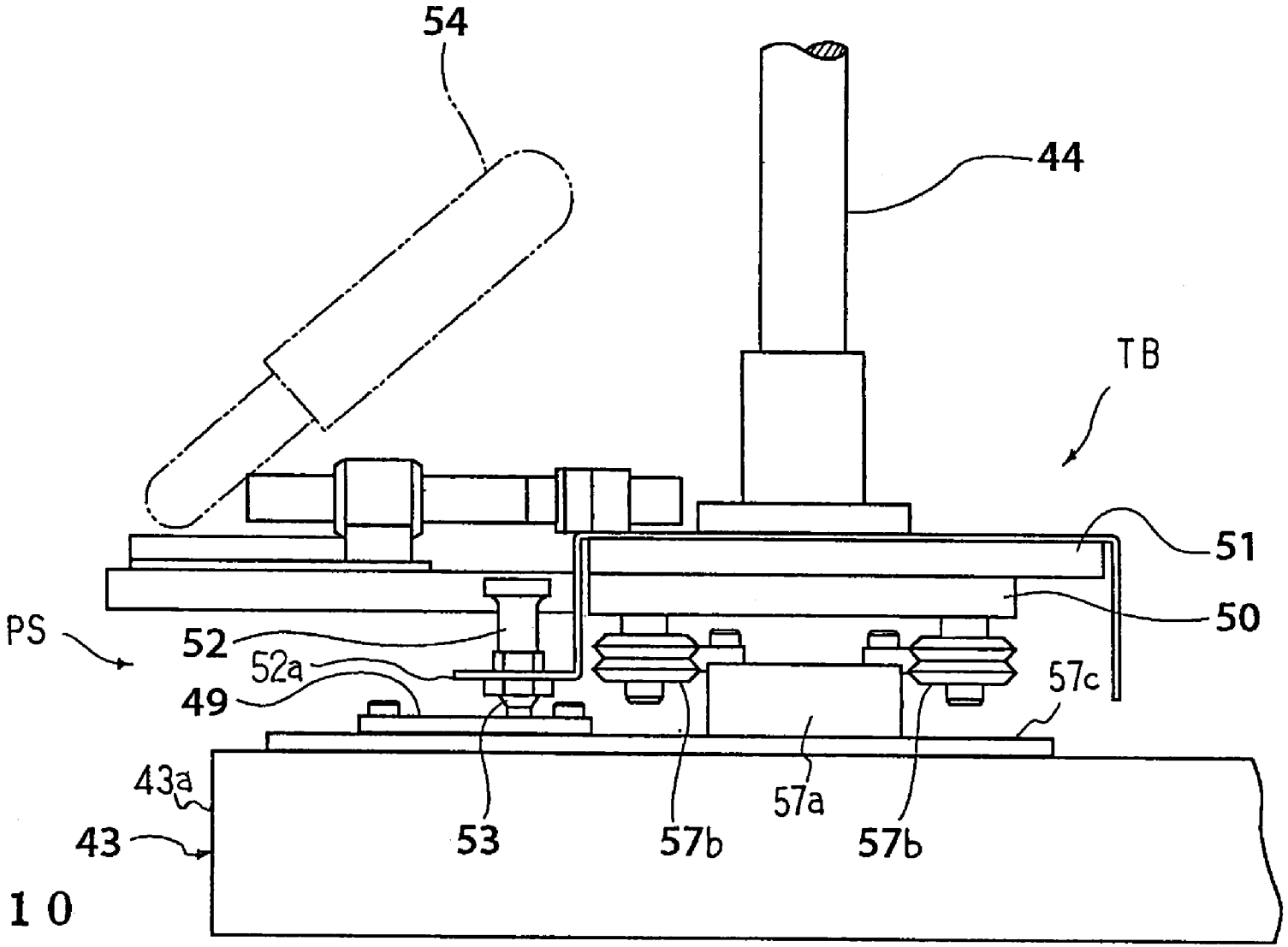
FIG. 10 is a side view showing the structure of a two-dimensionally movable table incorporated in the boring machine.
Figure 11:
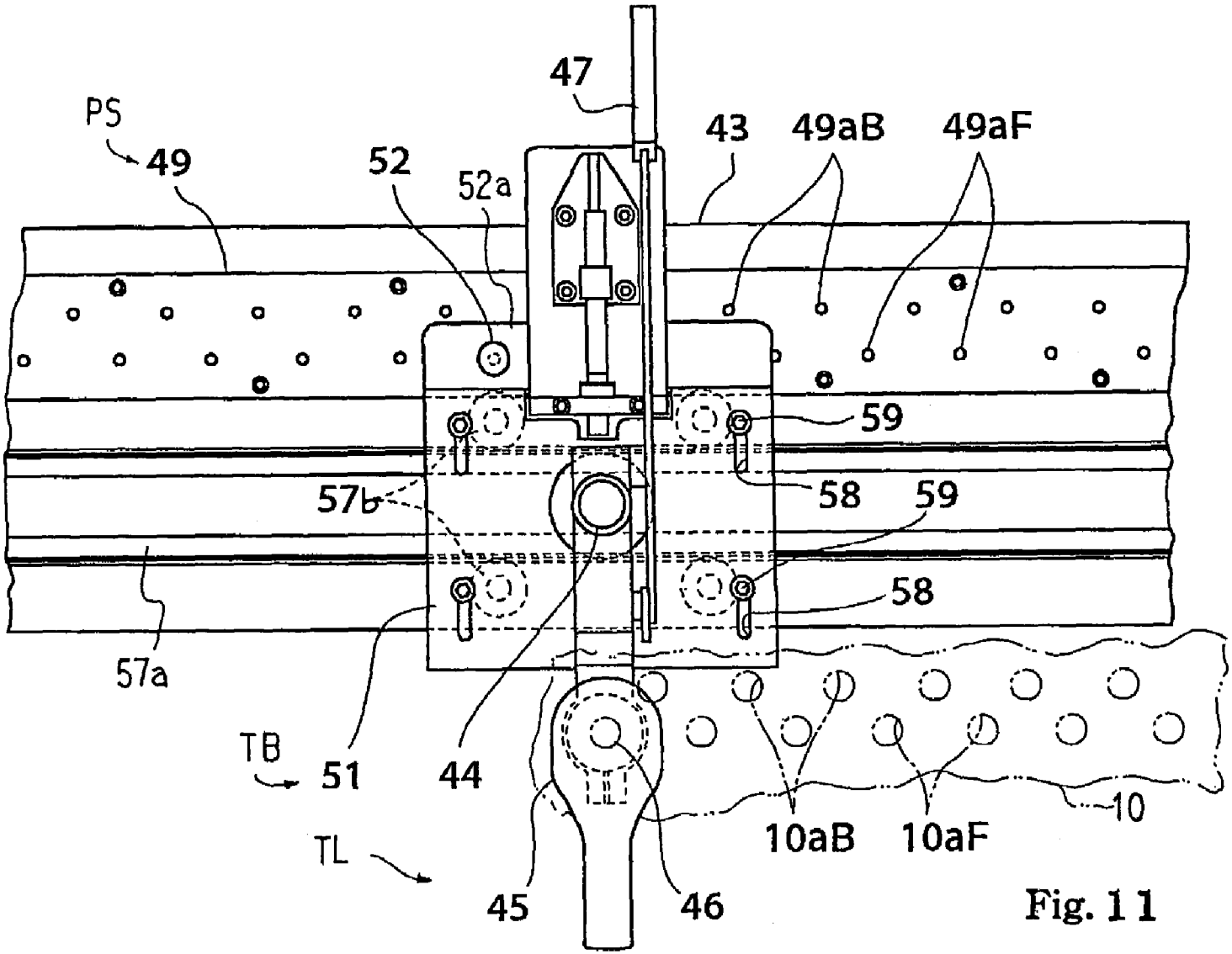
FIG. 11 is a plane view showing a tool post incorporated in the boring machine.

As will be better seen in FIG. 10, the two-dimensionally movable table TB includes two tables 50 and 51, and the upper table 51 is slidable on the lower table 50 in the fore-and-aft direction. The table 51 is formed with long holes 58 (see FIG. 11), and threaded holes (not shown) are formed in the other table 50. Bolts 59 pass through the long holes 58, respectively, and are held in threaded engagement with the threaded holes. When the worker loosens the bolts 59, the table 51 is released from the other table 50, and the worker moves the table 51 on the other table 50 in the fore-and-aft direction by manipulating a toggle lever 54 (see FIG. 10). When the table 51 reaches the appropriate position, the worker screws the bolts 59 into the threaded holes so that the bolts 59 press the table 51 to the other table 50. This results in that the table 51 can not change the relative position to the other table 50.

A rail 57*a* extends in the lateral direction, and is secured to a base plate 57*c*, which in turn is secured to the upper surface of the table 43*a*. Rollers 57*b* are hung from the table 50, and are engaged with the rail 57*a*. The rollers 57*b* roll on the side surfaces of the rail 57*a* so that the table 50 slides along the rail 57*a* in the lateral direction together with the other table 51. Thus, the table 51 is two-dimensionally movable on the tool table 43.

The positioning device PS includes a drill template 49 and a lock pin 52. The drill template 49 is secured to the base plate 57*c*, and extends in the lateral direction. On the other hand, the lock pin 52 is connected to the table 51 by means of a bracket 52*a*. Though not shown in the drawings, a spring always urges the lock pin 52 downwardly. Thus, the positioning device PS is partially provided on the tool table 43, and is partially carried on the two-dimensionally movable table TB.

Positioning holes 49*a*F and 49*a*B are formed in the drill template 49, and are arranged in two rows as similar to the target positions for the through-holes 10*a*F/10*a*B. The positioning holes 49*a*F of the front row are staggered with the positioning holes 49*a*B of the rear row, and the positioning holes 49*a*F and 49*a*B are spaced from one another at pitches equal to the pitches of the target positions for the through-holes 10*a*F and 10*a*B. This means that the drill template 49 is tailored for the specific model of the acoustic piano 100, and is exclusively used in the retrofitting work on the acoustic piano 100. In other words, when an acoustic piano of a different model is to be retrofitted to an automatic player piano, the workers changes the drill template 49 to another one tailored for the different model.

The drill template 49 is strictly positioned on the tool table 43 in such a manner that the positioning holes 49*a*F/49*a*B render the distance between the sealing poles 48 and the boring tool TL equal to the distance between the reference seal holes P2 and the target position for the through-holes 10*a*F/10*a*B. For this reason, when the lock pin 52 is inserted into one of the positioning holes 49*a*F/49*a*B, the boring tool TL is positioned beneath the target position for associated one of the through-holes 10*a*F/10*a*B.

The worker changes the boring tool TL from one positioning hole 49*a*F/49*a*B to another one as follows. The worker pinches the lock pin 52 with his or her fingers, and pulls up the lock pin 52 against the elastic force of the string so as to release the two-dimensionally movable table TB from the drill template 49. The worker sideward moves the two-dimensionally movable table 43, and aligns the lock pin 52 with the next positioning hole 49*a*F/49*a*B. The worker releases the lock pin 52 from the fingers. Then, the lock pin 52 downwardly projects from the bracket 52*a*, and is inserted into the next positioning hole 49*a*F/49*a*B.

The boring tool TL is mounted on the table 51, and includes a post 44, a duct cover 45, a drill 46 and a manipulating lever 47. The drill 46 is enclosed with the duct cover 45, and the duct cover 45 is connected through a flexible tube 42 to a dust eliminator 41 as shown in FIG. 7. The dust eliminator 41, flexible tube 42 and duct cover 45 form in combination the cleaner CL. Though not shown in the drawings, the drill 46 is coupled to a suitable power source such as, for example, an electric motor, and is moved in the up-and-down direction by means of the manipulating lever 47.

As described hereinbefore, the boring tool TL is strictly related to the individual black and white keys 100*h*/100*j* by means of the reference seal holes P2, adjusting device AD and positioning device PS. When the lock pin 52 is engaged with one of the positioning holes 49*a*F/49*a*B, the drill 46 is positioned beneath the target position for the through-hole 10*a*F/10*a*B. Then, the drill 46 is driven for rotation, and is lifted toward the target position by means of the manipulating lever 47. The drill 46 is brought into contact with the key bed 10 at the target position, and the through-hole 10*a*F/10*a*B is bored in the key bed 10 with the rotating drill 46.

Although the gadget PRO has been described with reference selectively to FIGS. 7 to 11, all the component parts are not shown in those figures. For example, the sealing pole 44, duct cover 45 and driving mechanism between the toggle lever 54 and movable table 51 are deleted from FIG. 10, and the toggle lever 54 and associated driving mechanism are deleted from FIG. 9. The reason why several component parts are deleted from the figures is that the component parts just described are well seen in selected one or ones of those figures.

The through-hole boring work proceeds as follows. First, the worker moves the gadget PRO into the space under the key bed 10. The carrier CR smoothly conveys the lifter LU and boring machine HO into the space. However, the boring machine HO may be separated from the carrier CR. In this instance, the carrier CR conveys only the lifter LU into the space, and the boring machine HO is assembled with the carrier CR thereafter. The lateral rigid beam 32 is made parallel to the front end portion 10*b* (see FIGS. 7 and 8), and the stoppers 56 are pressed against the floor. Then, the carrier CR becomes stationary on the floor, and the relative position to the acoustic piano 100 is never changed.

Subsequently, the worker manipulates the lever 33*b* so that the rod 33*a* causes the lateral rigid beam 32 to be brought into contact with the front end portion 10*b*. If the lateral rigid beam 32 is slightly deviated from the front end portion 10*b*, the worker makes the lateral rigid beam 32 aligned with the front end portion 10*b*. The worker manipulates the lever 33*b*, again, and the center jack 31 lifts the front end portion 10*b*. Then, the front legs 21*a* are spaced from the floor. The weight of the acoustic piano 100 is exerted through the lateral rigid beam 32 and center jack 31 on the carrier CR so that the carrier CR is strongly pressed against the floor. For this reason, the carrier CR and acoustic piano 100 are fixed to the relative position. As will be described in conjunction with the associated machining work, the front legs 21*a* are disassembled from the piano cabinet 100*a*, and are machined.

Subsequently, the worker releases the couplers 43*b* from the longitudinal beams 30*b*, and moves the tool table 43 so as to make the sealing poles 48 aligned with the reference seal holes P2, respectively. The worker manipulates the adjusters 60 so that the sealing poles 48 are inserted into the reference seal holes P2, respectively. Then, the worker fixes the tool table 43 with the framework 30. Thus, the tool table 43 is related to the keyboard 100*b* by means of the reference seal holes P2 and adjusting device AD.

Subsequently, the worker disengages the lock pin 52 from the drill template 49, and laterally moves the two-dimensionally movable table TB along the rail 57*a*. The worker makes the lock pin 52 aligned with the first positioning hole 49*a*F/49*a*B such as, for example, the leftmost positioning hole 49*a*B. The leftmost positioning hole 49*a*B is corresponding to the through-hole 10*a*B under the key assigned to the lowest pitch. Of course, the worker may select another positioning hole from the drill template 49.

When the lock pin 52 is aligned with the first positioning hole 49*a*B, the worker releases the lock pin 52 from the fingers, and the lock pin 52 is inserted into the first positioning hole 49*a*B so as to prevent the two-dimensionally movable table TB from further sliding motion. When the lock pin 52 is engaged with the first positioning hole 49*a*B, the distance between the left sealing pole 48 and the drill 46 is equal to the distance between the left reference seal hole P2 and the target position for the through-hole 10*a*B under the leftmost key 100*j*.

The bolts 59 are screwed into the threaded holes, and the drill 46 is fixed just under the target position. The drill 46 is driven for rotation, and the dust eliminator 41 starts to suck the air through the duct cover 45. The worker manipulates the lever 47 so as to move the drill 46 upwardly. The drill 46 is brought into contact with the key bed 10 at the target position, and forms the through-hole 10*a*B in the key bed 10. The duct cover 45 is held in contact with the lower surface of the key bed 10, and chips are perfectly sucked through the flexible tube 42 into the dust eliminator 41 together with the air.

A protecting wood plate may be attached to the lower surface of the key bed 10. In this instance, the drill 46 penetrates the protecting wood plate, and the through-hole 10*a*B is bored in the key bed 10. The protecting wood plate prevents the key bed 10 from burrs around the through-hole 10*a*B.

The worker loosens the bolts 59, and pulls up the lock pin 52. Then, the two-dimensionally movable table TB becomes freely movable on the tool table 43. The worker makes the lock pin 52 aligned with the next positioning hole 49*a*F/49*a*B, and permits the spring to insert the lock pin 52 into the next positioning hole 49*a*F/49*a*B. Then, the distance between the sealing pole 48 and the drill 46 becomes equal to the distance between the reference seal hole P2 and the target position for the through-hole 10*a*F/10*a*B under the next key 100*h*/100*j*. The worker bores the through-hole 10*a*F/10*a*B in the key bed 10 at the target position under the next key 100*h*/100*j*. The worker repeats the boring work, and bores the through-holes 10*a*F/10*a*B under all the black and white keys 100*h*/100*j*.

As will be understood, the gadget PRO assists the workers so that the boring tool HO sequentially forms the through-holes 10*a*F/10*a*B in the key bed 10 exactly at the target positions by virtue of the adjusting device AD and positioning device PS.

Associated Machining Work

Figure 12:
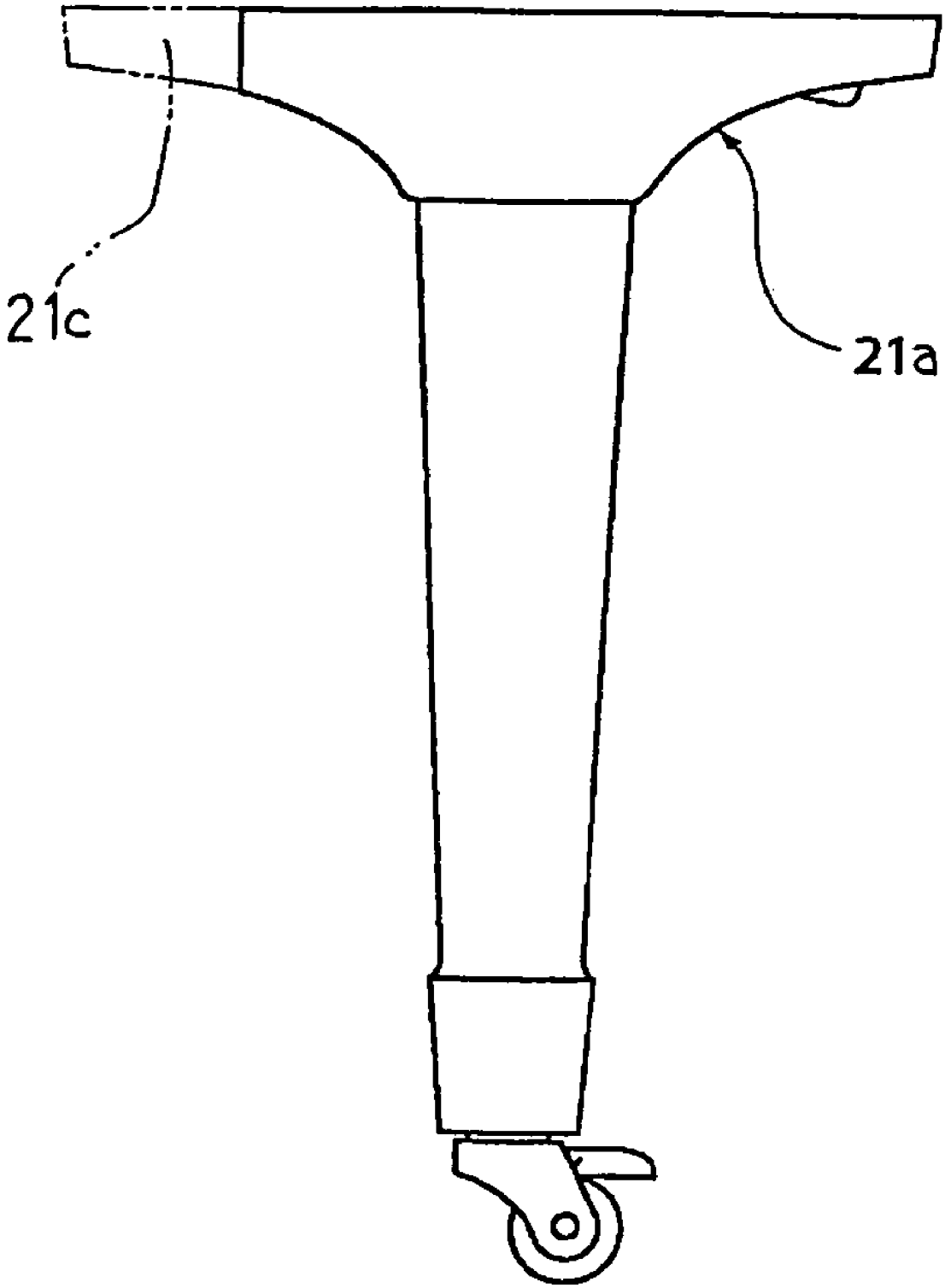
FIG. 12 is a side view showing a machining work on a front leg.

The associated machining work is carried out on the keyboard 100*b* and front legs 21*a*. The machining work on the keyboard 100*b* has been already described in conjunction with the first sub-work, and is not repeated for avoiding the repetition. The machining work on the front legs 21*a* is described with reference to FIG. 12.

When the center jack 31 lifts the front end portion 10*b* of the acoustic piano 100, the front legs 21*a* are spaced from the floor. Then, the worker disassembles the front legs 21*a* from the piano cabinet 100*a*. Since the rear portions 21*c* are overlapped with the target positions for the through-holes 10*a*B/10*a*F under the keys 100*h*/100*j* assigned to several lowest pitches and several highest pitches, the worker cuts away the rear portions 21*c*. Thus, the obstacle to the installation of the key drive unit KDU is removed from the acoustic piano 100. If the bolt holes were formed in the rear portions 21*c*, new bolt holes were bored in the remaining portions of the front legs 21*a* and, accordingly, the key bed 10.

If the solenoid-operated key actuators 62 are not required for the keys assigned the lowest pitches/highest pitches, the front legs 21*a* are neither disassembled from the piano cabinet 100*a*, nor machined for the rear end portions 21*c*. Moreover, if the front legs 21*a* are not any obstacle to the installation of the key drive unit KDU, the front legs 21*a* are also neither disassembled from the piano cabinet 100*a*, nor machined.

The machining work is not required for a keyboard, any part of which is not an obstacle to the plungers PJB. The machining work on the front legs 21*a* may be not required for several models of the acoustic piano as described hereinbefore. Thus, the associated machining work is not a dispensable step of the method for retrofitting according to the present invention.

Assembling Work

Prior to the assembling work, the tool table 43 may be removed from the carrier CR together with the boring tool TL. First, the front legs 21*a* are bolted to the key bed 10, and, thereafter, the worker renders the jack 31 retract the rod 33*a* downwardly. The lateral rigid beam 32 is spaced from the front end portion 10*b*, and the weight of the acoustic piano 100 is removed from the lifter LU. The worker lifts the stopper 56 so that the carrier CR becomes movable on the floor.

The worker moves the carrier CR frontward, and the lateral rigid beam 32 is moved out of the space under the acoustic piano 100. The worker places the key drive unit KDU on the lateral rigid beam 32, and moves the carrier CR into the space, again. The worker makes the plungers PJF/PJB aligned with the through-holes 10*a*F/10*a*B, respectively. The worker secures the brackets 61*a* to the key bed 10 by means of the bolts 61*c* (see FIG. 2), and lifts the lateral rigid beam 32 and, accordingly, the key drive unit KDU by means of the center jack 31. Then, the plungers PJF/PJB are respectively inserted into the through-holes 10*a*F/10*a*B. The worker secures the framework 61 to the brackets 61*a* by means of the bolts 61*b*. Thus, the key drive unit KDU is hung from the key bed 10. The manipulating panel (not shown) is attached to the piano cabinet 100*a*, and electrically connects the manipulating panel to the controller 63.

Upon completion of the assembling work, the worker moves the keyboard 100*b* onto the key bed 10, and mounts it thereon, again. After the security check, the acoustic piano 100 is tuned for performance.

As will be appreciated from the foregoing description, the reference seals P2 are formed in the key bed 10 on the basis of the keyboard 100*b*, and the adjusting device AD and positioning device PS make the boring tool TL related to the reference seals P2 and, accordingly, the keyboard 100*b*. The through-holes 10*a*F/10*a*B are sequentially bored in the key bed 10 at the target positions under the guidance of the positioning device PS so that the retrofitting work smoothly proceeds. A small amount of time and labor is merely consumed in the retrofitting work. This results in reduction of cost. Moreover, the undesirable influence of the through-holes on the key bed 10 is less than that of the slit. For example, the key bed 10 is less liable to be warped, and the tuning work is simple. This also results in reduction of cost.

The adjusting device AD, positioning device PS and boring tool TL are mounted on the single carrier CR, and are integrated into the gadget PRO. The relative position among the adjusting device AD, positioning device PS and boring tool TL is not changed on the carrier CR. For this reason, when the adjusting device AD is related to the reference seals P2, the positioning device PS and boring tool TL are also related to the reference seals P2 and, accordingly, the keyboard 100*b*. The positioning device PS sequentially makes the boring tool automatically aligned with the target positions for the through-holes so that the through-holes are exactly bored in the key bed 10.

Since the positioning device PS guides the boring tool TL to the target positions in the key bed 10, a worker without a skilled hand can exactly bore the through-holes 10*a*B/10*a*F in the key bed 10.

The drill templates have been already prepared for various models of acoustic piano. The worker is responsive to another model of acoustic piano by changing the drill template 49 to another one. In other words, the gadget PRO is available for all the models of acoustic piano. Moreover, even if the acoustic piano 100 is of the upright type, the gadget PRO is convenient to the workers.

Although particular embodiments of the present invention have been shown and described, it will be apparent to those skilled in the art that various changes and modifications may be made without departing from the spirit and scope of the present invention.

For example, the controller 63 may be combined with the manipulating panel. In this instance, the solenoid-operated key actuators 62 and controller 63 form in combination the key drive unit KDU.

In the first embodiment, the left locator P1 and left reference seal P2 are located relatively to the sixth key 100*k*, and the right locator P1 and right reference seal P2 are located relatively to the eighty-third key 100*m*. However, those keys 100*k* and 100*m* do not set any limit to the technical scope of the present invention. The locators P1 and reference seals P2 may be located relatively to another key or other keys in so far as the keys are sufficiently spaced from each other. The locators P1 and reference seals P2 may be located relatively to another component part of the keyboard 100*b*.

The marking tool 16 and felt pen 18 do not set any limit to the technical scope of the present invention. Another sort of clamping device is available for another sort of marker in so far as the target position is specified on the key bed 10. Otherwise, a jig or an appropriate measuring device may be used in the first sub-work. A suitable laser emitting tool may be attached to the key so as to scorch the target spot.

The reference seal holes P2 and sealing poles 48 do not set any limit to the technical scope of the present invention. The key bed 10 may be labeled with reflectors, which reflects light, instead of the holes P2. In this instance, the adjusting device AD is implemented by an optical scanner. The optical scanner sweeps the key bed 10 with a light beam to see where the reflection is increased. When the reflection is maximized at certain positions, the optical scanner causes the boring machine HO to stop the certain positions, thereby relating the boring machine HO to the keyboard 100*b*.

The counter holes P1 (T) do not set any limit to the technical scope of the present invention. A template may be formed with projections, which are snugly received in the locating recesses P1, instead of the counter holes P1 (T).

The two reference seal holes P2 do not set any limit to the technical scope of the present invention. A single or more than two reference seal holes may be bored in the key bed 10.

A jig may serve as both of the marking tool 16 and the template 17. In this instance, the jig is attached to predetermined key or keys. Then, the jig directly indicates the target position or positions of the reference seal holes P2 on the upper surface of the key bed 10. Using the jig, the worker drills the reference seal holes P2 in the key bed 10. Thus, the reference seal marking work is simplified.

The drill 46 guided by positioning device PS does not set any limit to the technical scope of the present invention. The combination of drill 46 and positioning device PS is replaceable with a computer-controlled machine such as, for example, an NC (Numeral Control) machine. In this instance, a cutting tool is mounted on a stage three-dimensionally movable by means of stepping motor units, and the stepping motor units are controlled by a small-sized computer system. The adjusting device AD makes the cutting tool related to the keyboard, and the cutting tool is sequentially moved to the target positions under the control of the small-sized computer system. In this instance, pieces of positional data may be given to the small-sized computer system at the user's home. The worker measures the pitches of the black and white keys and the distance between the reference seal and one of the black and white keys at the user's home, and inputs those pieces of positional data to the small-sized computer system. Thus, even if the model of an acoustic piano is unknown, or if there is not a drill template available for the acoustic piano, the worker can retrofit the acoustic piano to the automatic player piano with the assistance of the gadget equipped with the computer-controlled machine.

The plural positioning holes 49*a*B/49*a*F do not set any limit to the technical scope of the present invention. Only one or two positioning holes may be formed in a drill template. The positioning hole makes the boring tool TL related to a predetermined key 100*h*/100*j* so that the through-hole 10*a*F/10*a*B is bored in the key bed 10 with the drill 46. The boring tool TL is moved to the next target position on the basis of the through-hole 10*a*F/10*a*B, and form the other through-holes 10*a*F/10*a*B. For example, a pin is upright on the table 51, and the worker stops the boring tool TL when the pin is inserted into the through-hole 1-*a*F/10*a*B. When the pin is aligned with the previously bored through-hole, the drill 46 is exactly positioned at the next target position, and forms the next through-hole 10*a*F/10*a*B. Thus, the previously bored through-holes sequentially guide the drill 46 to the next target positions. In this instance, if the locating recess P1 is formed at the first target position, the locating recess/hole P1 serves as a prepared hole for the first through-hole 10*a*F/10*a*B, and the first through-hole is directly bored in the key bed 10. Thereafter, the pin, which is inserted into the first through-hole 10*a*B/10*a*F, guides the drill 46 to the next target position. Thus, the drill template 49*a* and lock pin 52 are not the indispensable element of the adjusting device AD.

The reference seals P2 may have been marked on the key bed in the factory before delivery to a user. In this instance, the reference seal marking work is not required at user's home for the retrofitting.

The acoustic piano 100 may be equipped with a hammer stopper and an electronic tone generating system. The hammer stopper is changed between a free position and a blocking position. While the hammer stopper is resting in the free position, the hammer stopper is out of the trajectories of the hammers 100*d*, and the hammers 100*d* strike the associated strings 100*e* without any interference so that the acoustic piano tones are generated through the vibrations of the strings 100*e*. When the hammer stopper is changed to the blocking position, the hammer stopper enters the trajectories of the hammers 100*d*. While a pianist is fingering a piece of music on the keyboard 100*b*, the hammers 100*d* are selectively driven for rotation. However, the hammers 100*d* rebound on the hammer stopper before striking the strings 100*e*. Thus, any acoustic piano tone is not generated. Instead, the electronic tone generating system produces electronic tones on the basis of the keys depressed by the pianist.

Claim languages are correlated with the component parts of the acoustic piano 100 and gadget PRO as follows. Terms "keyboard musical instrument" and "automatic player keyboard instrument" are respectively corresponding to the acoustic piano 100 and automatic player piano, respectively. The key bed 10 serves as "stationary board", and the action units 100*c*, hammers 100*d* and strings 100*e* as a whole constitute a "tone generating system".

The boring tool TL, tool table 43, two-dimensionally movable table TB as a whole constitute a boring unit. The sealing poles 48 serve as at least one counter seal. The pin 52 is corresponding to a "pointer", and the positioning holes 49*a*B/49*a*F are corresponding to "positioning marks".

What is claimed is:

1. A method for retrofitting a keyboard musical instrument to an automatic player keyboard instrument, comprising the steps of:

a) preparing an automatic playing system to be assembled with a keyboard musical instrument, which includes a cabinet having a stationary board, a keyboard having plural keys and mounted on said stationary board and a tone generating system responsive to a fingering on said keyboard for generating tones;

b) marking at least one reference seal in said stationary board at a certain position determined on the basis of said keyboard so that said at least one reference seal is related to said keyboard;

c) making a gadget related to said keyboard through said at least one reference seal;

d) forming holes at target positions in said stationary board by means of said gadget already related to said keyboard so that said holes are exactly located below said keys, respectively, and e) assembling a key drive unit of said automatic playing system with said stationary board in such a manner that plural plungers of said key drive unit pass through said holes, respectively.

2. The method as set forth in claim 1, in which said step b) includes the sub-steps of b-1) forming at least two locator on said stationary board at certain positions determined on the basis of said keyboard mounted on said stationary board by means of a marking tool attached to said keyboard, and b-2) marking said at least one reference seal at said certain position determined on the basis of said at least two locators.

3. The method as set forth in claim 1, in which said step b) includes the sub-steps of b-1) forming at least two locators on said stationary board at certain positions determined on the basis of said keyboard mounted on said stationary board by means of a marking tool attached to said keyboard, b-2) aligning counter marks of a template with said at least two locators so as to determine said certain position for said at least one reference seal, and b-3) marking said at least one reference seal at said certain position.

4. The method as set forth in claim 1, in which said step c) includes the sub-steps of c-1) aligning at least one counter seal already provided on said gadget with said at least one reference seal, and c-2) fixing said gadget to a position at which said at least one counter seal is aligned with said at least one reference seal.

5. The method as set forth in claim 1, in which said step d) includes the sub-steps of d-1) aligning a cutting tool of said gadget with one of said target positions determined on the basis of said at least one reference sign and pieces of positional data representative of a relation among said keys, d-2) boring the hole at said one of said target positions in said stationary board by means of said cutting tool, d-3) moving said cutting tool to another of said target positions for boring another of said holes, and d-4) repeating said sub-step d-3) until the last hole is bored in said stationary board.

6. The method as set forth in claim 5, in which said sub-step d-1) includes the sub-steps of d-1-1) aligning a pointer of said cutting tool with one of positioning marks formed on a template already prepared on said gadget, said positioning marks making a distance between at least one counter seal formed on said gadget and said cutting tool equal to a distance between said at least one reference seal and said target positions, and d-1-2) fixing said pointer to said one of said positioning marks so that said cutting tool get ready to bore said hole at said one of said target positions.

7. A method for forming holes in a stationary board where a keyboard is to be mounted, comprising the steps of:

a) marking at least one reference seal in said stationary board at a certain position determined on the basis of said keyboard so that said at least one reference seal is related to said keyboard;

b) making a gadget related to said keyboard through said at least one reference seal; and c) forming holes at target positions in said stationary board by means of said gadget already related to said keyboard so that said holes are exactly located below keys of said keyboard, respectively.

8. The method as set forth in claim 7, in which said step a) includes the sub-steps of a-1) forming at least two locator on said stationary board at certain positions determined on the basis of said keyboard mounted on said stationary board by means of a marking tool attached to said keyboard, and a-2) marking said at least one reference seal at said certain position determined on the basis of said at least two locators.

9. The method as set forth in claim 7, in which said step a) includes the sub-steps of a-1) forming at least two locators on said stationary board at certain positions determined on the basis of said keyboard mounted on said stationary board by means of a marking tool attached to said keyboard, a-2) aligning counter marks of a template with said at least two locators so as to determine said certain position for said at least one reference seal, and a-3) marking said at least one reference seal at said certain position.

10. The method as set forth in claim 7, in which said step b) includes the sub-steps of b-1) aligning at least one counter seal already provided on said gadget with said at least one reference seal, and b-2) fixing said gadget to a position at which said at least one counter seal is aligned with said at least one reference seal.

11. The method as set forth in claim 7, in which said step c) includes the sub-steps of c-1) aligning a cutting tool of said gadget with one of said target positions determined on the basis of said at least one reference sign and pieces of positional data representative of a relation among said keys, c-2) boring the hole at said one of said target positions in said stationary board by means of said cutting tool, c-3) moving said cutting tool to another of said target positions for boring another of said holes, and c-4) repeating said sub-step c-3) until the last hole is bored in said stationary board.

12. The method as set forth in claim 11, in which said sub-step c-1) includes the sub-steps of c-1-1) aligning a pointer of said cutting tool with one of positioning marks formed on a template already prepared on said gadget, said positioning marks making a distance between at least one counter seal formed on said gadget and said cutting tool equal to a distance between said at least one reference seal and said target positions, and d-1-2) fixing said pointer to said one of said positioning marks so that said cutting tool get ready to bore said hole at said one of said target positions.

13. A gadget for forming holes at target positions in a stationary board of a keyboard musical instrument marked with at least one reference seal at a certain position determined on the basis of a keyboard incorporated in said keyboard musical instrument, comprising:

a boring unit movable in an area where said keyboard musical instrument stands, and having a cutting tool movable toward said stationary board for boring said holes in said stationary board;

an adjusting device making said boring unit related to said keyboard through said at least one reference seal; and a positioning device moving said cutting tool to said target positions, said target positions being determined on the basis of said at least one reference seal and pieces of positional data representative of a relation between keys incorporated in said keyboard so that said holes are exactly located below said keys, respectively.

14. The gadget as set forth in claim 13, in which said boring unit further has a tool table fixed to a certain spot where said cutting tool is related to said keyboard through said at least one reference seal, said adjusting device and a part of said positioning device being fixed thereto, and a movable table two-dimensionally movable on said tool table and carrying said cutting tool and another part of said positioning device so that said cutting tool is aligned to said target positions through an engagement between said part and said another part.

15. The gadget as set forth in claim 14, in which a template formed with positioning marks and a pointer serve as said part and said another part, respectively, and in which said positioning marks making a distance between said adjusting device and said cutting tool equal to a distance between said at least one reference seal and said target positions.

16. The gadget as set forth in claim 15, in which positioning holes formed in said template and a lock pin engageable with said positioning holes serve as said positioning marks and said pointer, respectively.

17. The gadget as set forth in claim 13, in which said adjusting device is formed by at least one counter seal to be aligned with said at least one reference seal.

18. The gadget as set forth in claim 17, in which holes formed in said stationary bed and poles upright on said boring unit serve as said at least one reference seal and said at least counter seal, respectively, and said poles are inserted into said holes so as to make said boring unit related to said keyboard.

19. The gadget as set forth in claim 13, in which said positioning device includes a template formed with positioning marks and stationary to said adjusting device, and a pointer provided on said boring unit and engageable with said positioning marks for so as to make said cutting tool aligned with said target positions.

20. The gadget as set forth in claim 19, in which said positioning marks make a distance between said adjusting device and said cutting tool equal to a distance between said at least one reference seal and said target positions.

21. The gadget as set forth in claim 19, in which positioning holes formed in said template and a lock pin provided on said boring unit and insertable into said positioning holes serve as said positioning marks and said pointer, respectively.

* * * * *